United States Patent [19]

Robertson

[11] 4,006,697

[45] Feb. 8, 1977

[54] HIGH SPEED QUILTING MACHINE

[75] Inventor: Joe E. Robertson, Santa Ana, Calif.

[73] Assignee: Kirsch Company, Sturgis, Mich.

[22] Filed: Jan. 12, 1976

[21] Appl. No.: 648,002

[52] U.S. Cl. ..... 112/118

[51] Int. Cl.[2] ..... D05B 11/00

[58] Field of Search ..... 112/3 R, 3 A, 117–119

[56] References Cited

UNITED STATES PATENTS

| | | | |
|---|---|---|---|
| 2,218,785 | 10/1940 | Boettcher | 112/117 |
| 3,385,246 | 5/1968 | Schlegel | 112/118 |
| 3,465,697 | 9/1969 | Gerlach et al. | 112/118 |
| 3,749,037 | 7/1973 | Cash | 112/117 |
| 3,805,717 | 4/1974 | Gerlach et al. | 112/118 |

*Primary Examiner*—G. V. Larkin
*Attorney, Agent, or Firm*—Philip M. Hinderstein

[57] ABSTRACT

In a quilting machine of the type including a bed plate, material supporting means including material feeding means for conducting material to be quilted over the bed plate, sewing thread supply means, a plurality of vertically reciprocal needles positioned above the bed plate for moving sewing threads through the material and the bed plate, a plurality of horizontally reciprocal shuttles mounted below the bed plate and cooperating with the vertically reciprocal needles for forming lock stitches in the material, vertically reciprocal presser means positioned above the bed plate for holding the material on the bed plate during formation of the stitches, thread take-up means positioned between the thread supply means and the needles for controlling thread tension during the formation of the stitches, and pattern controlling means for moving the material supporting means laterally in a preselected relationship with the material feeding means for obtaining sewing patterns, there is disclosed an improvement wherein the needles are driven continuously between upper and lower positions with no delay or dwell time at the ends of their strokes and with no "hump" or other irregularities in their movement, wherein the timing of the thread take-up means is adjustable independently of the timing of the needles and is delayed with regard thereto, wherein the timing of the presser means is adjustable independently of the timing of the needles and is delayed with regard thereto, and wherein the length of the strokes of the shuttles is approximately 50% greater than the length of the shuttles.

28 Claims, 12 Drawing Figures

10
20
11
12
13
14
15
16
21
22
23
24
25
26
27
28
29
30
31
32
33
34
35
36
37
40
41
42
43
46
47
48
50
55
56
58
60
61
62
64
65
66
67
68
70
71
72
73
74
75
80
90
91
93
94
97
98
99
100
120
121
122
123
124
131
132
133
134
135
136
137
3
4

HIGH SPEED QUILTING MACHINE

BACKGROUND OF THE INVENTION

1. Field of the Invention

The present invention relates to a high speed quilting machine and, more particularly, to a quilting machine which is quieter and faster and operates with less downtime and for a longer period of time than quilting machines known heretofore.

2. Description of the Prior Art

Quilting machines of the general type including a bed plate, material supporting means including material feeding means for conducting material to be quilted over the bed plate, sewing thread supply means, a plurality of vertically reciprocal needles mounted on a needle support bar positioned above the bed plate for moving a plurality of threads through the material and the bed plate, vertically reciprocal presser means positioned above the bed plate for holding the material on the bed plate during formation of the stitches and for holding the material during removal of the needles therefrom, thread take-up means positioned between the thread supply means and the needles for controlling the tension in the threads during the formation of the stitches, and pattern controlling means for moving the material supporting means laterally in a preselected relationship with the material feeding means for obtaining sewing patterns, are generally old and well known in the art. An early quilting machine of this type is shown in U.S. Pat. No. 260,994, issued July 11, 1882, to William Koch. Since that time, such machines have become substantially more complex and a quilting machine of the type generally available today is shown in U.S. Pat. No. 3,385,246, issued May 28, 1968, to Kurt Schlegel.

Such machines stitch together an assembly of quilting fabrics and a filler in a pattern of stitches distributed throughout the area of the assembly. In the quilting operation, the fabrics are drawn from supply rolls while the filler is drawn from a supply roll between the fabrics to form an assembly of filler sandwiched between an upper and lower fabric. The assembly is then passed through the stitching mechanism by means of drawing rollers.

The stitching mechanism is a stationary unit and the bed plate has a plurality of holes therein, spaced transversely of the direction of movement of the material assembly, through which the needles may pass downwardly to shuttles or bobbins mounted beneath the bed plate, one for each hole and needle. Stitches are made by a downward movement of the needles through the material assembly and into and through the holes in the bed plate. Upon upward movement of the needles, loops are formed in the threads, below the bed plate, through which the shuttles or bobbins conduct second lengths of thread, whereupon the needles are further withdrawn and the threads pulled tight to form the stitches.

During the stitching operation, the presser plate is lowered onto the material assembly to hold it in place on the bed plate, whereupon the presser plate is elevated slightly to permit forward movement of the material assembly. The presser plate further limits upward movement of the assembly so that the needles may be withdrawn therefrom. The presser plate includes a similar plurality of transversely oriented holes aligned with the holes in the bed plate for passage therethrough of the needles during the stitching operaton.

Some quilting machines of the above type have used horizontally reciprocal shuttles, as in the beforementioned Schlegel quilting machine and as more fully described in U.S. Pat. No. 1,802,869, issued Apr. 28, 1931, to Gustav A. Boettcher and U.S. Pat. No. 3,253,558, issued May 31, 1966, to Fritz Hagen, while other quilting machines have used rotary bobbins of a type described in U.S. Pat. No. 1,221,857, issued Apr. 10, 1917, to August Hildt. The principal advantage which results from the use of a rotary bobbin is that the needles may be driven continuously, between upper and lower positions, with no delay or dwell time or other irregularities in the movement. Such needle movement is quieter and faster and minimizes the stresses on the needle mechanism so as to minimize machine downtime and increase the life of all parts.

On the other hand, there are a variety of overriding disadavantages that attach to quilting machines using rotary bobbins and, as a result, they are used very infrequently. For example, in order to provide a bobbin having enough thread capacity to eliminate the necessity for frequently stopping the machine to replace a bobbin, an amount of room would have to be provided for each bobbin which is simply unavailable in modern quilting machines having a large number of closely-spaced needles. Other problems result from the complexity of the necessary drive system for a multiple bobbin arrangement.

These disadvantages of a rotary bobbin do not exist with horizontally reciprocal shuttles. In a shuttle system, a series of parallel races are provided immediately below the bed plate and one, two, or more shuttles may be positioned in longitudinally-spaced relationship in each raceway. The multiple shuttles are driven back and forth by a shuttle stick which is supported with all other shuttle sticks so that all shuttle sticks and all shuttles are driven simultaneously. The needles are positioned so that the loops in the threads are formed in the raceways and the shuttles pass therethrough, creating a continuous lock stitch of the type shown in Federal Standard No. 751*a* Stitch Type 301.

In a conventional quilting machine of the type including plural, horizontally reciprocal shuttles, the needles are typically mounted on a needle support bar which is connected via a connecting rod and a lever to an oscillatory shaft. The oscillatory shaft is generally driven from the main drive shaft by means of an eccentric mounted on the main drive shaft, an eccentric ring mounted on the eccentric, and a connecting rod which connects the eccentric ring to a lever on the oscillatory shaft. Thus, rotation of the main drive shaft and the eccentric causes oscillation of the lever and the oscillatory shaft. The take-up mechanism, which may be a whip bar, butterfly, or the like, is mounted on a shaft which is either physically connected to the needle bar for movement therewith or which is connected to the oscillatory shaft by a connecting rod and a pair of levers so as to rock therewith.

A number of problems result from a mechanism of the type just described. Since the take-up mechanism is either directly connected to the needle bar or is directly driven by the needle bar drive shaft, both operate in timed sequence. Thus, as the needles begin to move downwardly, so does the take-up mechanism, providing slack in the threads at this time. Ocassionally, this slack causes one of the threads to loop under its associated needle and the needle snaps the thread as it moves downwardly into the material assembly. Each time this occurs, the machine must be stopped so that the thread can be rethreaded into the needle. Furthermore, until the broken thread is noticed, an irregularity occurs in the sewing pattern and this must be corrected at a subsequent time, typically by hand. This thread breakage is a substantial problem because it not only decreases machine efficiency but increases the labor required to quilt a given length of material.

It is not until the needles have reached the bottom of their strokes and started to move upwardly that loops are formed in the threads, beneath the material, for the shuttles to pass through. In a conventional machine, where the take-up mechanism operates synchronously with the needle bar drive, if the needles moved continuously, when they started to move upwardly, so would the take-up mechanism, preventing the formation of loops and the proper operation of the shuttles. To prevent this from happening, a variety of techniques have been developed for placing the needles "in neutral" as soon as the loops are formed to provide an opportunity for the shuttles to pass therethrough. In a mechanism of the type described previously, the most common technique for placing the needles in neutral is to cause the lever, which is positioned between the oscillatory shaft and the needle bar connecting rod, to pass beyond the point where the connecting rod and the lever are in line. Thus, considering, by way of example, one hand of a clock, the lever moves from some starting position, say 2:00 o'clock to 7:30, in a clockwise direction, and then back again, where the needles are in their lower position when the lever is at 6:00. When the needles start moving downwardly, with the lever at 2:00 o'clock, so does the take-up mechanism. When the lever reaches 6:00 o'clock, the shuttles begin to move forwardly. As the lever moves from 6:00 o'clock to 7:30, moving the needles upwardly, loops are formed for the shuttles to go through and the shuttles enter such loops. As the lever moves from 7:30 back to 6:00, the needles again move downwardly and the thread take-up mechanism begins to draw the thread in. However, since the needles are moving downwardly, the loops are maintained for continued passage of the shuttles therethrough. Finally, when the lever reaches 6:00 o'clock and starts moving back towards 2:00, the needles move upwardly with the take-up mechanism but, by now, the shuttles have passed sufficiently through the loops to insure stitch formation.

This hump in the needle stroke, or some equivalent mechanism, has been required in all prior quilting machines of the type including horizontally reciprocal shuttles. For a further discussion of this operation, reference should be had to U.S. Pat. No. 507,757, issued Oct. 31, 1893, to Louis Schultz, the beforementioned Schlegel U.S. Pat. No. 3,385,246, and British Patent No. 1,188,377.

A number of additional disadvantages result from this hump or delay in the needle stroke. The irregular movement of the needles and the oscillatory drive shaft required therefor contribute to the overall high noise level of the machine, which creates an uncomfortable working environment for the machine operator. The oscillatory movement of the needles and take-up drives creates vibrations which both limit the operating speed of the machine and increase the stress on the parts. As a result, most conventional quilting machines are highly inefficient, operate substantially less than 50% of the time, and must be overhauled frequently. Because of the number of variables that need to be monitored, a relatively highly skilled operator is required who must watch the machine constantly.

SUMMARY OF THE INVENTION

According to the present invention, there is provided a quilting machine that has the advantages of quilting machines having horizontally reciprocal shuttles and quilting machines having rotary bobbins but none of the disadvantages thereof. The present quilting machine includes horizontally reciprocal shuttles, but the needles are driven continuously, between upper and lower positions, with no delay or dwell time at the ends of the strokes and with no hump or other irregularities in the movement. Accordingly, the needles may be driven directly by a rotary shaft, eliminating the heretofore utilized oscillatory shaft. The present machine is, therefore, quieter and substantially faster and creates less stresses on the needle mechanism so as to minimize machine downtime and increase the life of all parts. With the present high speed quilting machine, the timing of the thread take-up mechanism may be adjusted independently of the timing of the needles and the timing is adjusted so as to virtually eliminate the thread breakage problem.

Not only may the present quilting machine be operated at a substantially higher speed than machines known heretofore, but the efficiency of the machine is substantially greater than that encountered heretofore because of the virtual elimination of the thread breakage problem. With the present machine, a shuttle running out of thread is just about the only reason that makes the operator turn the machine off.

By eliminating a substantial amount of the oscillatory movement, the present machine vibrates substantially less than prior machines and requires overhauling less frequently, thereby further increasing efficiency and decreasing operating costs. Furthermore, by decreasing the number of variables that an operator must monitor and increasing the efficiency of the machine, an operator having a lower level of skill and requiring less training may be used, thereby achieving a still further decrease in operating costs.

Briefly, the present quilting machine comprises a bed plate; material supporting means including material feeding means for conducting material to be quilted over the bed plate; sewing thread supply means; a plurality of vertically reciprocal needles positioned above the bed plate for moving threads through the material and the bed plate; a rotary drive shaft; means interconnecting the rotary drive shaft and the needles for vertically reciprocating the needles in a continuous, uninterrupted path between upper and lower positions, with no delay or dwell time at the ends of the strokes and with no hump or other irregularities in the movement; a plurality of horizontally reciprocal shuttles mounted beneath the bed plate and cooperating with the vertically reciprocal needles for forming lock stitches in the material; vertically reciprocal presser means positioned above the bed plate for holding the material on the bed plate during formation of the stitches; thread take-up means positioned between the thread supply means and the needles for controlling the tension in the threads during formation of the stitches; means for driving the thread take-up means, the timing of the thread take-up means driving means being adjustable independently of the timing of the needles; and pattern controlling means for moving the material supporting means laterally in a preselected relationship with the material feeding means for obtaining sewing patterns.

According to the present invention, the present high speed quilting machine has the timing of the take-up means driving means adjusted relative to the timing of the needles so that the take-up means is increasing the tension in the threads when the needles begin to move downwardly and only begins to decrease the tension in the threads when the needles have moved downwardly approximately one-quarter of the way between the upper and lower positions thereof and so that the take-up means is decreasing the tension in the threads when the needles begin to move upwardly and only begins to increase the tension in the threads when the needles have moved upwardly approximately one-quarter of the way between the lower and upper portions thereof.

Also according to the present invention, the present high speed quilting machine comprises means for driving the shuttles continuously between forward and rearward positions so as to pass through loops formed in the threads by the needles beneath the material, wherein the length of the stroke of the shuttles is approximately 50% greater than the length of the shuttles themselves. This increases the speed of the shuttles as they pass through the loops in the threads, increasing sewing efficiency.

OBJECTS

It is therefore an object of the present invention to provide a high speed quilting machine.

It is a further object of the present invention to provide a high speed quilting machine, utilizing horizontally reciprocal shuttles, which is quieter and faster than quilting machines known heretofore.

It is a still further object of the present invention to provide a high speed quilting machine which operates more efficiently than quilting machines known heretofore.

It is another object of the present invention to provide a high speed quilting machine which incorporates independent drives for the needle bar, the take-up reel, and the presser plate to eliminate needle hump.

It is still another object of the present invention to provide a high speed quilting machine wherein the thread breakage problem has been substantially minimized.

Another object of the present invention is the provision of a high speed quilting machine which may be operated by a worker having a lower level of skill than required heretofore.

Still another object of the present invention is the provision of a high speed quilting machine of the type including horizontally reciprocal shuttles wherein the needles are driven continuously between upper and lower positions with no delay or dwell time at the ends of the strokes and with no hump or other irregularities in the needle movement.

An additional object of the present invention is the provision of a high speed quilting machine incorporating horizontally reciprocal shuttles wherein the length of the strike of the shuttles is substantially increased over that utilized heretofore.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
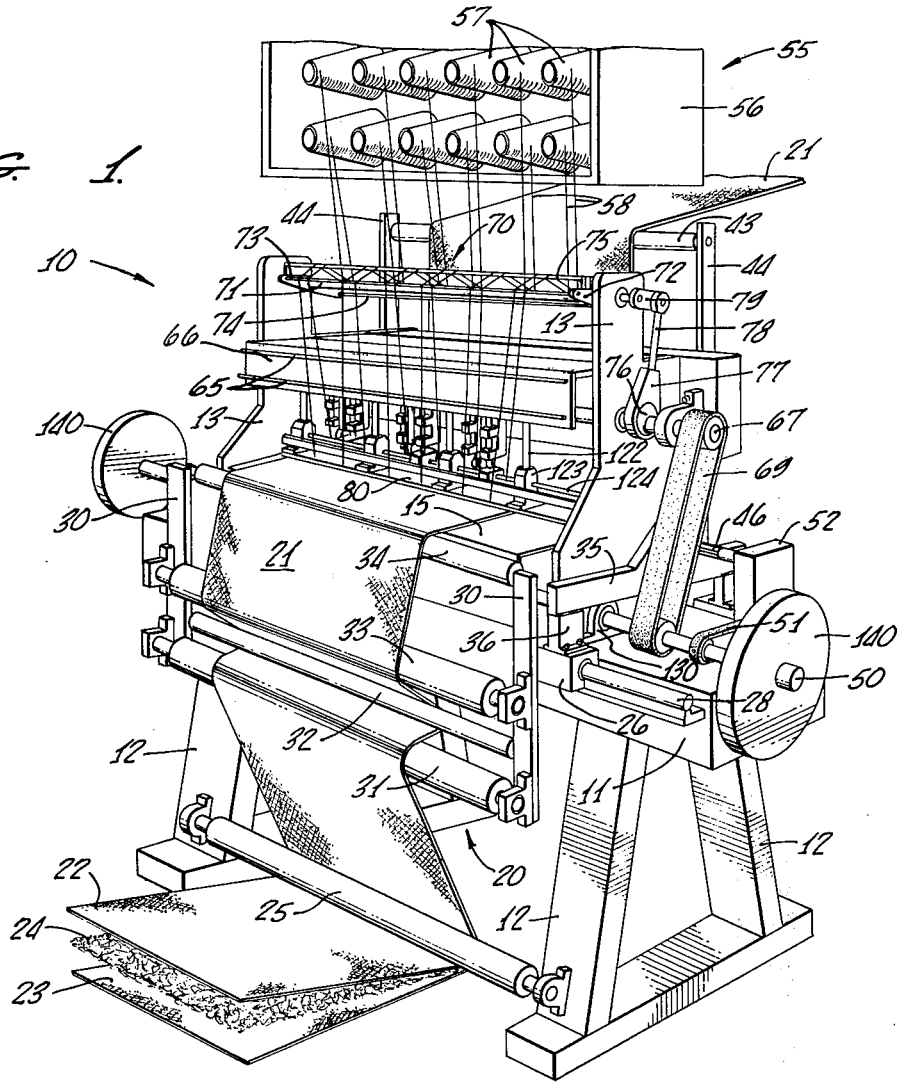
FIG. 1 is a front perspective view of a high speed quilting machine constructed in accordance with the teachings of the present invention.
Figure 2:
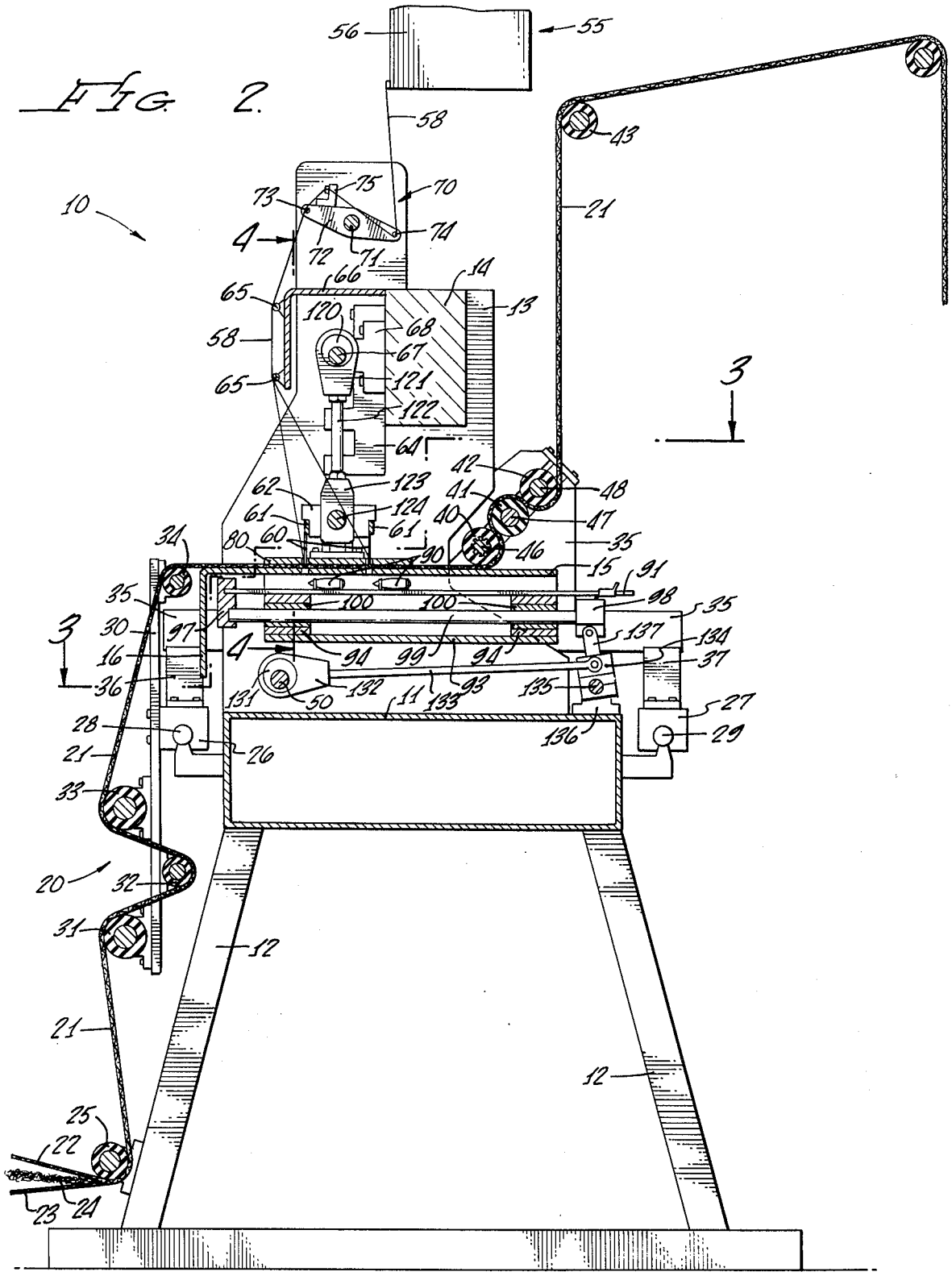
FIG. 2 is an enlarged, lateral sectional view taken through the approximate center of the quilting machine of FIG. 1.
Figure 3:
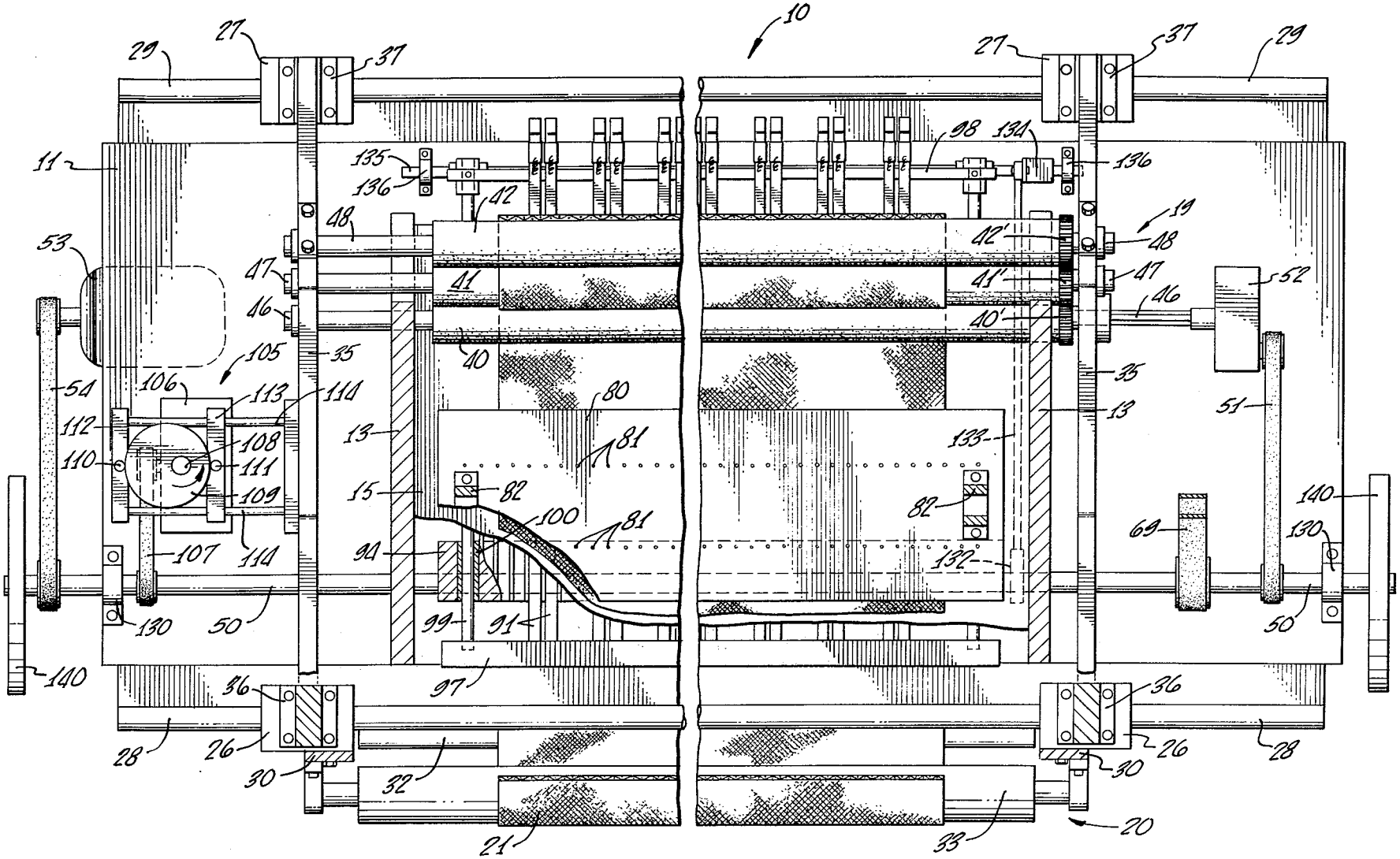
FIG. 3 is an enlarged, partial sectional view taken along the line 3—3 in FIG. 2.

Referring now to the drawings and, more particularly, to FIGS. 1–3 thereof, the present high speed quilting machine, generally designated 10, includes a main frame 11 which is rigidly mounted horizontally above a support surface by a plurality of legs 12. Frame 11 supports a pair of rigid frame stands 13 which extend vertically upwardly adjacent the opposite ends of frame 11, frame stands 13 supporting a rigid bridge member 14. Members 11–14 provide a rigid base for the operating members of quilting machine 10 and all remaining parts are connected to one or more of these members.

Quilting machine 10 includes an elongate bed plate 15 which extends horizontally between stands 13 and which has a downwardly extending lip 16 at the front end thereof to enclose the movable parts therebelow. Bed plate 15, in the present embodiment, has two rows of multiple holes 17 therein, spaced transversely of the direction of movement of material over bed plate 15, there being one hole 17 in bed plate 15 for each sewing needle of quilting machine 10, as will be described more fully hereinafter.

Quilting machine 10 further includes material supporting means, generally designated 20, including material feeding means, generally designated 19, for conducting material to be quilted over bed plate 15. More particularly, quilting machine 10 is designed to stitch together a material assembly 21 consisting of two sheets of quilting fabric 22 and 23 and a length of filler material 24. Fabric 22 and 23 and filler 24 are drawn from supply rolls, not shown, to form assembly 21. Assembly 21 is passed around a first roller 25 connected between the two front legs 12 of machine 10 and then to material supporting means 20. Supporting means 20 includes a pair of spaced front bearings 26 and a pair of spaced rear bearings 27 which are mounted on guide rails 28 and 29 respectively, connected to the front and back, respectively, of main frame 11. Connected to bearings 26 and a pair of vertical bars 30 which have connected therebetween a plurality of vertically spaced rollers 31–34. Thus, as bearings 26 move along guide rail 28, bars 30 and rollers 31–34 move laterally therewith. As shown in FIGS. 1 and 2, material assembly 21, after extending under roller 25, passes in front of and over roller 31, in back of roller 32, in front of roller 33, and in front of and over roller 34, assembly 21 emerging parallel to and immediately above bed plate 15.

Material supporting means 20 further includes a pair of carriage cross members 35 positioned parallel to and just to the outside of stands 13. Each carriage member 35 is connected by means of brackets 36 and 37 to one set of front and rear bearings 26 and 27, respectively. Thus, carriage members 35 move laterally, relative to bed plate 15, with bearings 26 and 27. Connected between members 35, at the rear end of quilting machine 10, are three parallel, spaced rollers 40, 41, and 42. Upon passing over roller 34, material assembly 21 is conducted horizontally, immediately above and in contact with bed plate 15 and passes in back of roller 40, in front of roller 41, and in back of roller 42. Material assembly 21 is then conducted over a stationary roller 43 which is connected between a pair of support members 44 which may be mounted on frame 11. Thus, elements 25 through 37 and 40–42 form a rigid assembly which is movable as a unit along guide rails 28 and 29 connected to frame 11. Material supporting means 20 collates and maintains material assembly 21 taut as it is conducted over bed plate 15.

The feeding of material assembly 21 over bed plate 15 is achieved by driving rollers 40–42. That is, material feeding means 19 includes rollers 40–42 which are mounted on shafts 46–48, respectively. Shaft 46, for example, may be a splined shaft which is driven from a main drive shaft 50 by means of a belt 51 and a gear box 52, shaft 46 being the output of gear box 52. Thus, rotation of drive shaft 50, as described hereinafter, drives gear box 52 via belt 51, rotating splined shaft 46. Shaft 46 rotates roller 40 while permitting lateral movement thereof with material supporting means 20. Furthermore, the rotation of roller 40 may be conducted to rollers 41 and 42 by mounting gears 40'–42' on rollers 40–42, respectively, and interconnecting the teeth of such gears.

Quilting machine 10 further includes sewing thread supply means, generally designated 55, including a container 56 mounted above quilting machine 10, in any suitable manner, container 56 supporting a plurality of spools 57 of thread 58, there being at least one spool 57 for each of the needles of machine 10. Sewing thread supply means 55 is conventional and well known to those skilled in the art.

Figure 4:
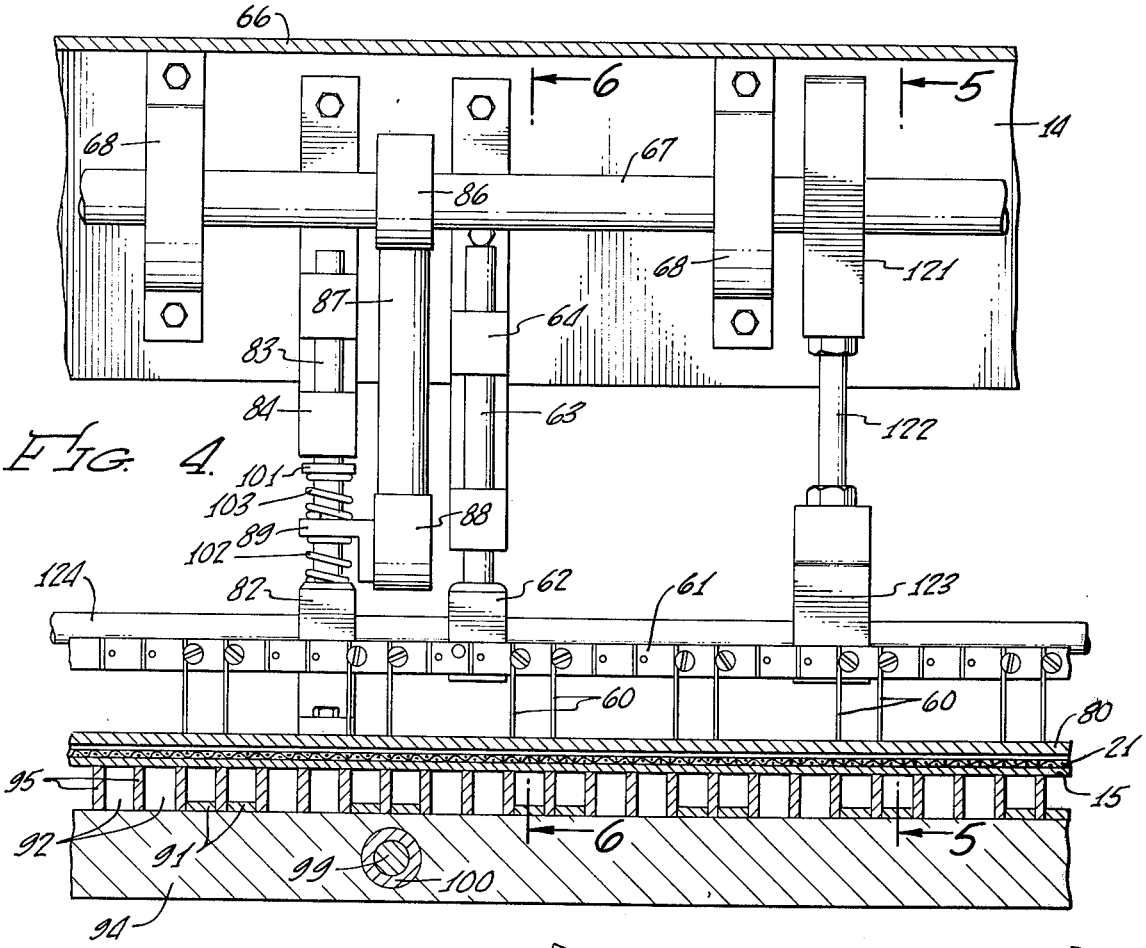
FIG. 4 is an enlarged, partial sectional view taken along the line 4—4 in FIG. 2.
Figure 5:
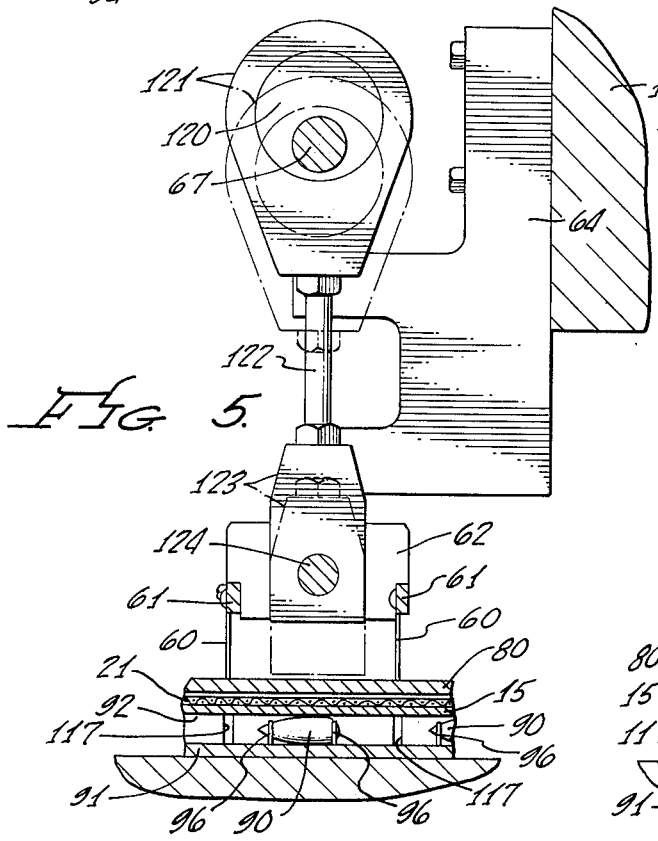
FIGS. 5 and 6 are partial sectional views taken along the lins 5—5 and 6—6 in FIG. 4.
Figure 6:
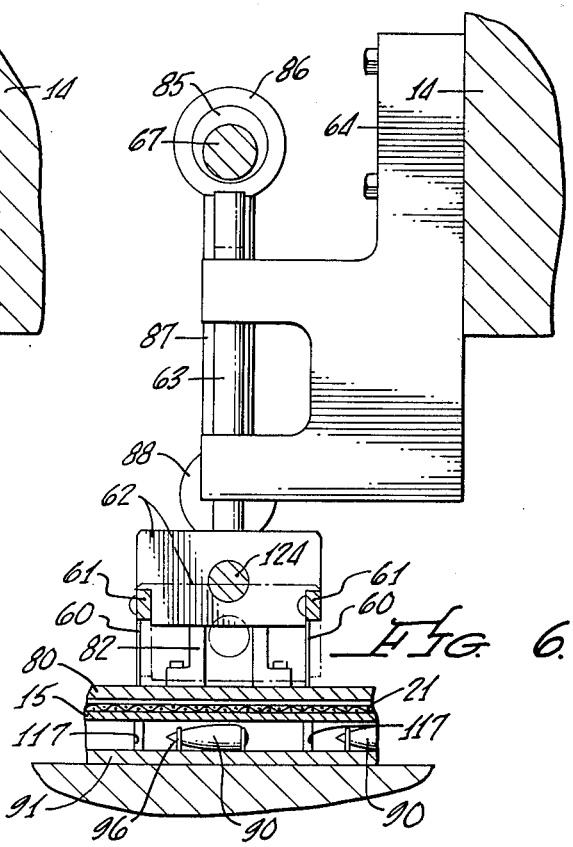

Referring now also to FIGS. 4–6, quilting machine 10 further includes a plurality of vertically reciprocal needles 60 positioned above bed plate 15 for moving threads 58 through material assembly 21 and bed plate 15. More specifically, needles 60 are arranged in one or more rows, each row of needles 60 being connected to an elongate support bar 61. By way of example, two rows of needles 60 and two support bars 61 are shown in the present embodiment. Support bars 61 are supported at a plurality of locations along the lengths thereof by brackets 62, each bracket 62 being connected to the lower end of a rod 63. Rods 63 are mounted for vertically reciprocal movement in bearing blocks 64, which are rigidly connected to bridge 14. Thus, needles 60, needle support bars 61, brackets 62, and rods 63 move vertically as a single unit relative to bearing blocks 64. Furthermore, one of threads 58 from sewing thread supply means 55 is conducted to each of needles 60 passed a pair of rails 65 connected to the front of an elongate, generally L-shaped plate 66 which is connected to bridge 14, between stands 13, and covers the driving mechanism for needles 60, to be described more fully hereinafter.

Quilting machine 10 further includes thread take-up means, generally designated 70, positioned between thread supply means 55 and needles 60 for controlling the tension in threads 58 during operation of quilting machine 10. Thread take-up means 70 may be any conventional tensioning device known to those skilled in the art. By way of example, thread take-up means 70 may include an elongate shaft 71 mounted for pivotal movement between stands 13, shaft 71 supporting a pair of brackets 72 at the opposite ends thereof, adjacent stands 13. Connected between the opposite ends of brackets 72 is a pair of elongate bars 73 and 74, thus providing a construction wherein bars 73 and 74 are parallel to each other and to shaft 71 and are equally spaced on opposite sides thereof. Also connected between arms 72 is an eyelet bar 75 which is positioned parallel to bars 73 and 74, above shaft 71, and which has a plurality of holes therein, one for each of threads 58.

As shown most clearly in FIG. 2, each of threads 58 is conducted from its associated spool 57 in thread supply means 55 downwardly to thread take-up means 70. Each thread 58 passes in back of and under bar 74, through one of the openings in bar 75, and then over and in front of bar 73, from where it is conducted via rails 65 to one of needles 60. As will be explained more fully hereinafter, shaft 71 oscillates through an angle of approximately 30° between a position where bar 73 is extending upwardly and bar 74 is extending downwardly and a position where bar 73 is extending downwardly and bar 74 is extending upwardly. As bar 73 moves upwardly, the tension in threads 58 is increased. As bar 73 moves downwardly, the tension in threads 58 is decreased.

Quilting machine 10 further includes presser means, including an elongate, generally rectangular, planar presser plate 80 positioned above bed plate 15, parallel thereto, for holding material assembly 21 down on bed plate 15 during a portion of the stitching cycle and also for limiting the upward movement of material assembly 21 so that needles 60 may be withdrawn therefrom. As is conventional in the art, presser plate 80 has a plurality of rows of multiple holes 81 therein, two rows in the present embodiment, spaced transversely of the direction of movement of material assembly 21 over bed plate 15, there being one hole 81 in presser plate 80 for each sewing needle 60 and for each hole 17 in bed plate 15. By aligning holes 81 in presser plate 80 with holes 17 in bed plate 15, needles 60 may reciprocate therethrough so that presser plate 80 does not interfere with the sewing operation.

Presser plate 80 is supported at a plurality of locations along the length thereof by a series of generally U-shaped brackets 82 which are connected to the lower ends of support rods 83. Rods 83 are mounted for vertical reciprocation in bearing blocks 84, which are similar in construction and operation to bearing blocks 64 for rods 63. Bearing blocks 84 are likewise connected to bridge member 14. Thus, presser plate 80, brackets 82 and rods 83 vertically reciprocate relative to quilting machine 10 via the support provided by bearing blocks 84.

Quilting machine 10 further includes a plurality of horizontally reciprocal shuttles 90 mounted below bed plate 15, which cooperate with vertically reciprocal needles 60 for forming lock stitches in material assembly 21, particularly Federal Standard Stitch Type 301. Shuttles 90, the mounting thereof, and the operation thereof are generally well known to those skilled in the art. Generally, one or more shuttles 90 are mounted on a shuttle stick 91 and are horizontally reciprocated therewith through a raceway 92. By way of example, an elongate, generally rectangular, planar bed stand 93 extends between bridge members 13, parallel to and below bed plate 15. Mounted above bed stand 93, at the front and rear edges thereof, are a pair of identical, elongate, bed bars 94, the upper surfaces of which are parallel and spaced from the bottom surface of bed plate 15. Extending vertically between the lower surface of bed plate 15 and the upper surfaces of bars 94 are a plurality of parallel, spaced races 95 which define the opposite sides of raceways 92. Thus, and as shown most clearly in FIG. 4, the sides of each raceway 92 are defined by adjacent races 95, the bottom of each raceway 92 is defined by a shuttle stick 91 which rests on the upper surfaces of bars 94, and the top of each raceway 92 is defined by the lower surface of bed plate 15.

One shuttle 90 is positioned in each raceway 92 for each row of needles 60. Thus, in the present example, which includes two rows of needles 60, each raceway 92 is provided with a pair of shuttles 90. Each pair of shuttles 90 is mounted for horizontal movement between a pair of pins 96 connected to shuttle stick 91. Thus, pins 96 move shuttles 90 forwardly and rearwardly through raceways 92 as shuttle sticks 91 reciprocate longitudinally.

As seen most clearly in FIGS. 2 and 4, shuttle sticks 91 are positioned parallel, spaced, coplanar relationship, with each shuttle stick 91 being positioned parallel to the direction of movement of material assembly 21 through machine 10. The leading edges of all shuttle sticks 91 are releasably supported by a front drive bar 97 which extends transversely of quilting machine 10, adjacent lip 16 of bed plate 15, whereas the rear ends of all shuttle sticks 91 are releasably supported by a back drive bar 98 which extends transversely of machine 10, adjacent the rear end thereof. Bars 97 and 98 are interconnected by means of a plurality of spaced, parallel, connecting rods 99, each of which extends through aligned bearings 100 in bed bars 94. Thus, bars 97 and 98, connecting rods 99, shuttle sticks 91, and shuttles 90 move as a unit, relative to bars 94 and bed plate 15.

Quilting machine 10 further includes pattern controlling means 105 for moving material supporting means 20 laterally in a preselected relationship with material feeding means 19 for obtaining sewing patterns. Pattern controlling means 105 may be any conventional means and, by way of example, may include a gear box 106 driven from drive shaft 50 via a belt 107. Gear box 106 has an output shaft 108 on which is mounted a cam 109. A pair of cam followers 110 and 111 are positioned on opposite sides of cam 109, in contact with the perimeter thereof, cam followers 110 and 111 being mounted on terminal blocks 112 and 113, respectively. Blocks 112 and 113 are connected to one of carriage members 35 of material supporting means 20 by means of a pair of shafts 114. Thus, the rotation of drive shaft 50 drives output shaft 108 and cam 109 by means of belt 107 and gear box 106, the rotation of cam 109 driving cam followers 110 and 111 from side to side. This sideward movement of cam followers 110 and 111 is transmitted via bearing blocks 112 and 113 and shafts 114 to member 35 of material supporting means 20 for lateral movement thereof in a preselected relationship, depending upon the shape of cam 109, as material assembly 21 is conducted through quilting machine 10.

According to the present invention, needles 60 are driven directly from main drive shaft 50 in a continuous, regular path between upper and lower positions, with no delay or dwell time at the ends of their strokes and with no hump or other irregularities in their movement. This is achieved, most simply, by mounting a secondary drive shaft 67 along the front of bridge 14, shaft 67 being supported for rotation relative to bridge 14 by means of a plurality of spaced bearings 68. As shown most clearly in FIG. 1, secondary drive shaft 67 may be driven directly from primary drive shaft 50 by means of a belt 69, as known in the art.

Shaft 67 extends across the front of quilting machine 10, directly above needle support bars 61. A plurality of spaced eccentrics 120 are positioned along shaft 67, each eccentric 120 having an eccentric follower ring 121 associated therewith. Each follower ring 121 is connected via a connecting rod 122 to a terminal block 123, all of which are connected to an elongate shaft 124 which extends transversely of quilting machine 10, between support bars 61. Shaft 124 extends through and is connected to each of brackets 62 and also extends through without contacting brackets 82. Thus, shaft 124 interconnects brackets 62, support bars 61, and needles 60 and the entire assembly is driven in a continuous oscillatory fashion by eccentrics 120, which are driven continuously with shaft 67 from main drive shaft 50. It is significant to note that shaft 67 is a rotary shaft rather than an oscillatory shaft, as will be described more fully hereinafter.

Also according to the present invention, thread take-up means 70 is driven in such a manner that the timing thereof may be adjusted independently of the timing of needles 60. That is, and as shown most clearly in FIG. 1, a second eccentric 76 may be mounted on secondary drive shaft 67 so that the angular orientation thereof is independently adjustable relative to the angular orientation of eccentrics 120. Eccentric 76 has an eccentric follower ring 77 associated therewith which is connected via a connecting rod 78 to one end of a lever 79, the other end of which is connected to shaft 71. Thus, as eccentric 76 rotates with secondary drive shaft 67, connecting rod 78 oscillates longitudinally, rocking lever 79 and shaft 71, operating thread take-up means 70, as described previously.

According to the present invention, presser plate 80 is also driven in such a manner that the timing thereof may be adjusted independently of the timing of needles 60 and the timing of take-up means 70. As shown most clearly in FIGS. 4 and 6, presser plate 80 is preferably driven directly from secondary drive shaft 67 by mounting thereon a plurality of spaced eccentrics 85, the angular orientation of which may be adjusted independently of the angular orientation of eccentrics 120 and eccentric 76. Each eccentric 85 has mounted thereon an eccentric follower ring 86 which is connected via a connecting rod 87 and a bracket 88 to an L-shaped bracket 89 having a hole therein through which one of rod 83 passes. Each rod 83 has mounted thereon a collar 101, just below a bearing block 84, each bracket 89 being positioned midway between a collar 101 and a bracket 82. A first spring 102 surrounds each rod 83 and extends between the brackets 82 and 89 associated with such rod. A second spring 103 surrounds each rod 83 and extends between the bracket 89 and the collar 101 associated with such rod.

As shaft 67 rotates, rotating eccentrics 85 therewith, follower rings 86, connecting rods 87, and brackets 88 and 89 are caused to oscillate in a vertical direction. As brackets 89 move upwardly, simultaneously increasing the compression of springs 103 and decreasing the compression of springs 102, collars 101 are urged upwardly while the downward force on brackets 82 is reduced. The overall effect is to elevate rods 83, brackets 82, and presser plate 80. When brackets 89 move downwardly, reversing the situation, the compression of springs 102 increases while the compression of springs 103 decreases so that brackets 82 and presser plate 80 move downwardly. For a fuller discussion of the operation of presser plate 80, reference should be had to my copending U.S. patent application Ser. No. 648,003, filed concurrently herewith.

The drive for shuttles 90 may best be seen with regard to FIGS. 1, 2, and 3. That is, main drive shaft 50 is mounted for rotation on frame 11 by means of a plurality of spaced bearings 130. Mounted on main drive shaft 50 are a plurality of spaced eccentrics 131, the angular positions of which may be adjusted independently of the angular positions of eccentrics 120, 85, and 76 so that the timing of shuttles 90 may be adjusted independently of the timing of the remaining reciprocatory elements of quilting machine 10. Each of eccentrics 131 has an eccentric follower ring 132 associated therewith which is connected via a connecting rod 133 to one end of a lever 134, the other ends of which are connected to a shaft 135 which is pivotably connected to the rear of frame 11 by means of a plurality of spaced bearings 136. Also connected to shaft 135 are first ends of a plurality of spaced levers 137, the other ends of which are connected to bar 98 at points spaced along the length thereof.

Rotation of main drive shaft 50 and eccentrics 131 therewith causes longitudinal reciprocation of connecting rods 133 and pivoting of levers 134. Levers 134 cause shaft 135 to oscillate, pivoting levers 137 and oscillating shuttle sticks 91 and shuttles 90 in a forward and backward direction.

The driving of main drive shaft 50 may be achieved in any convenient manner. A motor 53 may be mounted on the floor adjacent quilting machine 10 and connected to main drive shaft 50 by a belt 54. Drive shaft 50 may have one or more flywheels 140 mounted thereon to insure smoothness of operation of quilting machine 10.

OPERATION

The operation of quilting machine 10 is, broadly speaking, similar to known quilting machines of this type. More specifically, quilting machine 10 is operative to stitch together material assembly 21 which consists of a length of filler material 24 sandwiched between two lengths of fabric 22 and 23. Material assembly 21 is supported by material supporting means 20 and is passed along a horizontal plane, from roller 34 to roller 40, between bed plate 15 and presser plate 80, beneath needle support bars 61. Material assembly 21 is driven past bed plate 15 by means for drive rollers 40, 41, and 42 which are driven, as described previously, from main drive shaft 50. As rollers 40–42 convey material assembly 21 longitudinally over bed plate 15, pattern controlling means 105 causes material supporting means 20 to move laterally in a preselected pattern under control of cam 109. Accordingly, by proper selection of cam 109 and the gear ratio of gear box 106 relative to gear box 52, by means of which the lateral speed of material supporting means 20 may be adjusted relative to the longitudinal speed of material assembly 21, any desired pattern may be selected.

The stitching mechanism of quilting machine 10 remains stationary relative to frame 11 and includes bed plate 15 which has holes 17 therein arranged in two rows, spaced transversely of the direction of the movement of material assembly 21. Needles 60 pass downwardly through holes 17 in bed plate 15, through aligned holes 81 in presser plate 80, and through material assembly 21 into grooves 117 in the sides of races 95, on first sides of raceways 92. Upon upward movement of needles 60, loops 59 are formed in threads 58, below bed plate 15, which loops 59 extend into raceways 92. It is through these loops 59 in threads 58 that shuttles 90 pass, as shuttle sticks 91 reciprocate through raceways 92. As needles 60 are withdrawn further, take-up means 70 pulls threads 58 to form a continuous lock stitch.

During this stitching operation, presser plate 80 is lowered onto material assembly 21 to hold material assembly 21 tightly on bed plate 15 and to compress material assembly 21 to aid in the efficient formation of loops 59 in threads 58. At a preselected time, to be discussed more fully hereinafter, after needles 60 begin moving upwardly, presser plate 80 is elevated slightly to permit forward movement of material assembly 21. Presser plate 80 moves upwardly only slightly to also function to limit the upward movement of material assembly 21 so that needles 60 may be withdrawn therefrom.

Figures 7A, 7B, 7C, 7D, 7E, 7F:
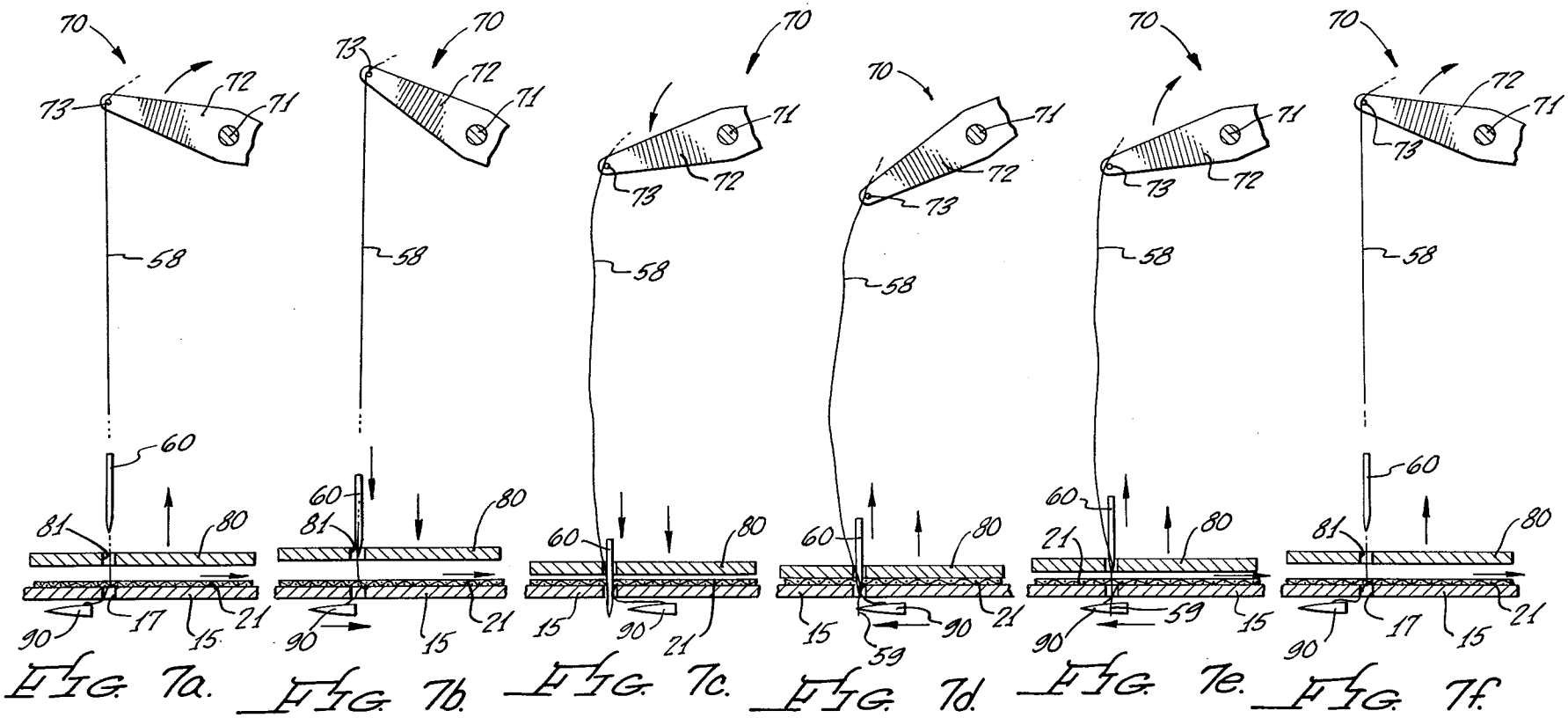
FIGS. 7A through 7F are a series of schematic representations showing the relative timing between the needles, the take-up mechanism, the shuttles, and the presser plate.

Referring now to FIGS. 7A through 7F, the timing of the reciprocatory parts of quilting machine 10 which permits the use of horizontally reciprocal shuttles with a continuous needle drive may be better understood. FIG. 7A shows the relative positions of needles 60, take-up means 70, shuttles 90, and presser plate 80 at the moment that needles 60 have reached the top of their strokes. At this moment, needles 60 have completed their upward movement and are ready to start moving downwardly. At this time, shuttles 90 have moved to the front of their strokes, have completed their forward movement and are about to start moving rearwardly. On the other hand, neither take-up mechanism 70 nor presser plate 80 are at a turning point in their strokes. That is, eccentric 76 has an angular orientation relative to eccentrics 120 which is delayed by approximately 450°. As a practical matter, this delay may vary between approximately 75° and approximately 15°, with approximately 45° being the preferred delay. Accordingly, in the positions shown in FIG. 7A, bar 73 is moving upwardly, although decelerating.

A similar situation exists with regard to presser plate 80. That is, eccentrics 85 have an angular orientation relative to eccentrics 120 so that there is a delay of approximately 30°. While this delay between presser plate 80 and needles 60 may vary between approximately 45° and approximately 15°, approximately 30° has been found to be preferable. Accordingly, in the positions shown in FIG. 7A, presser plate 80 is moving upwardly, although decelerating.

In FIG. 7B, shafts 50 and 67 have rotated 45° from their positions in FIG. 7A. Thus, needles 60 have begun moving downwardly and shuttles 90 have begun moving rearwardly. On the other hand, bar 73 of take-up means 70 has just reached the upper end of its stroke, is no longer moving upwardly and is about to start moving downwardly. Presser plate 80 has just previously reached the upper end of its stroke and has started its downward movement, eccentrics 85 moving only 15° beyond their top positions.

A significant difference between quilting machine 10 and prior quilting machines can now be seen. That is, as needles 60 begin to move downwardly, take-up means 70 is still increasing rather than decreasing the tension in threads 58. Thus, at this time, no slack is created in threads 58 between needles 60 and take-up means 70. This virtually eliminates the tendency for threads 58 to loop under needles 60, thereby minimizing the greatest cause of thread breakage encountered heretofore.

In FIG. 7C, shafts 50 and 67 have rotated 180° from their positions in FIG. 7A and needles 60 have reached the bottom of their strokes and are neither moving upwardly nor downwardly. Similarly, shuttles 90 have reached the rear ends of their strokes and are neither moving rearwardly nor forwardly. It can therefore be seen that needles 60 and shuttles 90 operate in exact timed sequence, reversing their directions at the same instant. Thus, as needles 60 begin to move upwardly, shuttles 90 begin to move forwardly and vice versa. On the other hand, bar 73 is still moving downwardly and take-up mechanism 70 is still decreasing the tension in threads 58. Presser plate 80 is also continuing to move downwardly.

As explained previously, it is not until needles 60 begin to move upwardly that loops 59 are formed in threads 58, beneath material assembly 21, for shuttles 90 to pass through. FIG. 7D shows the positions of all elements after shafts 50 and 67 have rotated an additional 45° from their positions in FIG. 7C. Needles 60 have moved upwardly during this 45° of rotation and loops 59 have been formed. Shuttles 90 have moved forwardly during this 45° of rotation and have begun their passage through loops 59. On the other hand, during this entire interval, bar 73 has continued to move downwardly, decreasing rather than increasing the tension in threads 58. Furthermore, during the first two-thirds of this interval, which is sufficient to permit the points of shuttles 90 to reach and enter loops 59, presser plate 80 has also been moving downwardly, compressing material assembly 21. It is only during the last one-third of this interval that presser plate 80 begins to release material assembly 21.

A number of differences between quilting machine 10 and prior quilting machines may now be seen. Since take-up means 70 is timed independently of needles 60, it does not begin to pull threads 58 upwardly when needles 60 begin to move upwardly. Since presser plate 80 is applying the maximum compression to material assembly 21 at this time, the density of assembly 21 is at its maximum value, firmly holding the rear ends of loops 59 relative to material assembly 21 as needles 60 form the front ends of loops 59, beneath bed plate 15, in raceways 92. Thus, for a substantial interval after needles 60 begin to move upwardly, well-defined loops 59 appear in raceways 92 for shuttles 90 to move through.

Furthermore, and in accordance with the teachings of the present invention, shuttles 90 travel through loops 59 at a substantially greater speed than achieved heretofore, so as to insure that shuttles 90 are well into loops 59 before thread take-up means 70 begins to draw threads 58 tightly. According to the present invention, this increase in the speed of shuttles 90 is achieved by increasing the length of the stroke of shuttle sticks 91. In other words, accepted practice is to move the tips of shuttles 90¼ inches past needles 60 during their rearward movement and to move the rear ends of shuttles 90¼ inches past needles 60 during their forward movement, the total stroke of shuttles 90 being equal to their length plus ½ inch. This stroke typically remains the same, regardless of the length of shuttles 90.

According to the present invention, shuttles 90 are retracted by a significantly greater amount from needles 60 and extend forwardly an equal distance beyond needles 60, the length of the stroke of shuttles 90 being at least approximately 50% greater than the length of shuttles 90. Since the timing of shuttles 90 is synchronized with that of needles 60, the time that it takes shuttles 90 to go from the rearward position to the forward position remains the same, regardless of the length of the stroke. It therefore follows that the greater the length of the stroke, the greater the velocity of shuttles 90 so that they cover the increased distance in the same time. Accordingly, by starting shuttles 90 at a more rearward position, by the time shuttles 90 reach needles 60, loops 59 are well defined and shuttles 90 are moving at a substantial speed, sufficient to travel well into loops 59 prior to the time that substantial tension is applied to threads 58.

In FIG. 7E, shafts 50 and 67 have rotated an additional 45° from their positions in FIG. 7D. Needles 60 are now halfway between their lower and upper positions and bar 73 of take-up means 70 has begun moving upwardly, increasing the tension in threads 58. Shuttles 90 are now halfway through loops 59 and presser plate 80 is still moving upwardly. Needles 60, take-up means 70, shuttles 90 and presser plate 80 continue their movement in the same directions, as just described, for the next 90° of rotation of shafts 50 and 67 until needles 60 reach their upper positions and shuttles 90 reach their forward positions, as shown in FIG. 7F. It will be seen that FIG. 7F, which represents the completion of the cycle, is identical to FIG. 7A where the cycle begins.

Between the positions shown in FIGS. 7E and 7F, while needles 60 continue to move upwardly, take-up means 70 continues to draw threads 58 upwardly, increasing the tension in threads 58. However, by the time that take-up means 70 starts to pull threads 58 upwardly, shuttles 90 are well into loops 59 and fully emerge therefrom at an intermediate position between those shown in FIGS. 7E and 7F. Furthermore, take-up means 70 continues to increase the tension in threads 58 until the position shown in FIG. 7B so that take-up means 70 has adequate time to form the stitches in material assembly 21 after shuttles 90 have passed through loops 59. Furthermore, as soon as needles 60 emerge from material assembly 21, presser plate 80 has moved upwardly by an amount sufficient to release material assembly 21 from bed plate 15 so that it can be conveyed forwardly by feeding means 19, so as to advance an incremental amount before needles 60 again pass through presser plate 80 and reach material assembly 21.

It can therefore be seen that according to the present invention, there is provided a high speed quilting machine 10 that has all of the advantages of quilting machines having horizontally reciprocal shuttles and quilting machines having rotary bobbins, but none of the disadvantages thereof. Quilting machine 10 incorporates horizontally reciprocal shuttles 90, but needles 60 are driven continuously, between upper and lower positions, with no delay or dwell time at the ends of their strokes and with no hump or other irregularities in their movement. Accordingly, needles 60 may be driven directly by a rotary shaft 67, eliminating the heretofore utilized oscillatory shaft. Machine 10 is, therefore, quieter and substantially faster and creates less stresses on the needle mechanism so as to minimize machine downtime and increase the life of all parts.

With quilting machine 10, the timing of thread take-up mechanism 70 may be adjusted independently of the timing of needles 60 and the timing is adjusted so as to solve two problems. First of all, since the tension in threads 58 is increasing when needles 60 begin moving downwardly, the thread breakage problem is virtually eliminated. Furthermore, since take-up means 70 is decreasing the tension in threads 58 when needles 60 begin moving upwardly, shuttles 90 have adequate time to move well into loops 59 before take-up means 70 begins to pull threads 58 in.

Not only may quilting machine 10 be operated at a substantially higher speed than machines known heretofore, but the efficiency of machine 10 is several times greater than that encountered heretofore because of the virtual elimination of the thread breakage problem. With machine 10, just about the only reason that causes the operator to turn the machine off is a shuttle 90 running out of thread.

Because of the elimination of a substantial amount of the oscillatory movement encountered with prior quilting machines, the vibration in machine 10 is substantially less than encountered heretofore, requiring less frequent overhauling, thereby further increasing the efficiency and decreasing operating costs. Furthermore, by decreasing the number of variables that an operator must monitor and increasing the efficiency of machine 10, an operator having a lower level of skill and requiring less training may be used, thereby achieving a still further decrease in operating costs.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In a quilting machine of the type including a bed plate, material supporting means including material feeding means for conducting material to be quilted over said bed plate, sewing thread supply means, vertically reciprocal needles positioned above said bed plate for moving sewing threads through said material and said bed plate, horizontally reciprocal shuttles mounted beneath said bed plate and cooperating with said vertically reciprocal needles for forming lock stitches in said material, vertically reciprocal presser means positioned above said bed plate for holding said material on said bed plate during formation of said stitches, thread take-up means positioned between said thread supply means and said needles for controlling the tension in said threads during said formation of said stitches, and pattern controlling means for moving said material supporting means laterally in a preselected relationship with said material feeding means for obtaining sewing patterns, the improvement comprising:

means for driving said needles continuously between upper and lower positions, with no delay or dwell time at the ends of the strokes of said needles and with no hump or other irregularities in the movement thereof.

2. In a quilting machine according to claim 1, the improvement further comprising:

means for driving said thread take-up means, the timing of said thread take-up means driving means being adjustable independently of the timing of said needles.

3. In a quilting machine according to claim 2, the improvement wherein the stroke of said take-up means is delayed by approximately 45° relative to the stroke of said needles.

4. In a quilting machine according to claim 2, the improvement wherein the stroke of said take-up means is delayed relative to the stroke of said needles by an amount within the range of approximately 75° to approximately 15°.

5. In a quilting machine according to claim 4, the improvement further comprising:

means for driving said presser means, the timing of said presser means driving means being adjustable independently of the timing of said needles.

6. In a quilting machine according to claim 5, the improvement wherein the stroke of said presser means is advanced by approximately 15° relative to the stroke of said take-up means.

7. In a quilting machine according to claim 5, the improvement wherein the timing of the stroke of said presser means is approximately the same as that of said take-up means.

8. In a quilting machine according to claim 7 of the type further including means for driving said shuttles continuously between forward and rearward positions so as to pass through loops formed in said threads, by said needles, beneath said material, the improvement wherein:

the length of the stroke of said shuttles is approximately 50% greater than the length of said shuttles.

9. In a quilting machine according to claim 8, the improvement wherein the timing of said shuttles driving means is adjusted relative to the timing of said needles driving means so that said shuttles are in said rearward positions when said needles are in said lower positions and said shuttles are in said forward positions when said needles are in said upper positions.

10. In a quilting machine according to claim 9, the improvement wherein the stroke of said take-up means is delayed by approximately 45° relative to the stroke of said needles.

11. In a quilting machine according to claim 2 of the type including a plurality of vertically reciprocal needles mounted in side-by-side relationship on a needle support bar and at least one rotary drive shaft, the improvement wherein said needles driving means comprises:

an eccentric mounted on said drive shaft for continuous rotation therewith;

an eccentric follower operatively connected to said eccentric for reciprocatory movement during rotation of said eccentric; and means connecting said follower and said needle support bar for vertically reciprocating said support bar in a continuous, regular path upon rotation of said drive shaft.

12. In a quilting machine according to claim 11, the improvement wherein said thread take-up means driving means comprises:

a second eccentric mounted on said drive shaft for continuous rotation therewith, the angular orientation of said second eccentric being independently adjustable relative to that of said first-mentioned eccentric;

a second eccentric follower operatively connected to said second eccentric for reciprocatory movement during rotation of said second eccentric; and second means connecting said second follower and said thread take-up means.

13. In a quilting machine according to claim 12, the improvement further comprising:

means for driving said presser means, the timing of said presser means driving means being adjustable independently of the timing of said needles, said presser means driving means comprising:

a third eccentric mounted on said drive shaft for continuous rotation therewith, the angular orientation of said third eccentric being independently adjustable relative to that of said first and second eccentrics;

a third eccentric follower operatively connected to said third eccentric for reciprocatory movement during rotation of said third eccentric; and third means connecting said third follower and said presser means.

14. In a quilting machine according to claim 13 of the type further including means for driving said shuttles continuously between forward and rearward positions so as to pass through loops formed in said threads, by said needles, beneath said material, the improvement wherein the length of the stroke of said shuttles is approximately 50% greater than the length of said shuttles, wherein the timing of said shuttles driving means is adjusted relative to the timing of said needles driving means so that said shuttles are in said rearward positions when said needles are in said lower positions and said shuttles are in said forward positions when said needles are in said upper positions, wherein the stroke of said take-up means is delayed by approximately 45° relative to the stroke of said needles, and wherein the stroke of said presser means is advanced by approximately 15° relative to the stroke of said take-up means.

15. In a quilting machine according to claim 1 of the type further including means for driving said shuttles continuously between forward and rearward positions so as to pass through loops formed in said threads, by said needles, beneath said material, the improvement wherein:

the length of the stroke of said shuttles is approximately 50% greater than the length of said shuttles.

16. In a quilting machine according to claim 15, the improvement wherein the timing of said shuttles driving means is adjusted relative to the timing of said needles driving means so that said shuttles are in said rearward positions when said needles are in said lower positions and said shuttles are in said forward positions when said needles are in said upper positions.

17. A quilting machine comprising:

a bed plate;

material supporting means including material feeding means for conducting material to be quilted over said bed plate;

sewing thread supply means;

vertically reciprocal needles positioned above said bed plate for moving sewing threads through said material and said bed plate;

a rotary drive shaft;

means interconnecting said rotary drive shaft and said needles for vertically reciprocating said needles along a continuous, uninterrupted path between upper and lower positions;

horizontally reciprocal shuttles mounted in said bed plate and cooperating with said vertically reciprocal needles for forming lock stitches in said material;

vertically reciprocal presser means positioned above said bed plate for holding said material on said bed plate during formation of said stitches;

thread take-up means positioned between said thread supply means and said needles for controlling the tension in said threads during said formation of said stitches;

means for driving said thread take-up means, the timing of said thread take-up means driving means being adjustable independently of the timing of said needles; and pattern controlling means for moving said material supporting means laterally in a preselected relationship with said material feeding means for obtaining sewing patterns.

18. A quilting machine according to claim 17 wherein the timing of said take-up means driving means is adjusted relative to the timing of said needles so that said take-up means is increasing the tension in said thread when said needles begin to move downwardly and is decreasing the tension in said thread when said needles begin to move upwardly.

19. A quilting machine according to claim 18 wherein said take-up means begins to decrease the tension in said thread when said needles have moved downwardly approximately one-quarter of the way between said upper and lower positions thereof.

20. A quilting machine according to claim 18 wherein the stroke of said take-up means is delayed relative to the stroke of said needles by an amount within the range of approximately 75° to approximately 15°.

21. A quilting machine according to claim 18 further comprising:

means for driving said presser means, the timing of said presser means driving means being adjustable independently of the timing of said needles.

22. A quilting machine according to claim 21 wherein the timing of said presser means driving means is adjusted relative to the timing of said needles so that said presser means is decreasing the pressure on said material when said needles begin to move downwardly and is increasing the pressure on said material when said needles begin to move upwardly.

23. A quilting machine according to claim 17 further comprising:

means for driving said shuttles continuously between forward and rearward positions so as to pass through loops formed in said threads, by said needles, beneath said material, the length of the stroke of said shuttles being approximately 50% greater than the length of said shuttles.

24. A quilting machine according to claim 23 wherein the timing of said shuttles driving means is adjusted relative to the timing of said needles so that said shuttles are in rearward positions when said needles are in said lower positions and said shuttles are in said forward positions when said needles are in said upper positions.

25. A quilting machine according to claim 17 wherein said means interconnecting said rotary drive shaft and said needles comprises:

a first eccentric mounted on said rotary drive shaft for continuous rotation therewith;

first eccentric follower means associated with said first eccentric for reciprocatory movement during rotation of said first eccentric; and first means connecting said first eccentric follower means and said needles for vertically reciprocating said needles upon rotation of said drive shaft.

26. A quilting machine according to claim 25 wherein said thread take-up means driving means comprises:

a second eccentric mounted on said drive shaft for continuous rotation therewith, the angular orientation of said second eccentric being independently adjustable relative to that of said first eccentric;

second eccentric follower means associated with said second eccentric for reciprocatory movement during rotation of said second eccentric; and second means connecting said second eccentric follower means and said thread take-up means.

27. A quilting machine according to claim 26 further comprising:

a third eccentric mounted on said drive shaft for continuous rotation therewith, the angular orientaton of said third eccentric being independently adjustable relative to that of said first and second eccentrics;

third eccentric follower means associated with said third eccentric for reciprocatory movement during rotation of said third eccentric; and third means connecting said third eccentric follower means and said presser means for driving said presser means.

28. A quilting machine according to claim 27 further comprising:

means for driving said presser means, the timing of said presser means driving means being adjustable independently of the timing of said needles, the timing of said presser means driving means being adjusted relative to the timing of said needles so that said presser means is decreasing the pressure on said material when said needles begin to move downwardly and is increasing the pressure on said material when said needles begin to move upwardly; and means for driving said shuttles continuously between forward and rearward positions so as to pass through loops formed in said threads, by said needles, beneath said material, the length of the stroke of said shuttles being aproximately 50% greater than the length of said shuttles, the timing of said shuttles driving means being adjusted relative to the timing of said needles so that said shuttles are in said rearward positions when said needles are in said lower positions and said shuttles are in said forward positions when said needles are in said upper positions; and wherein the timing of said take-up means driving means is adjusted relative to the timing of said needles so that said take-up means is increasing the tension in said thread when said needles begin to move downwardly and is decreasing the tension in said thread when said needles begin to move upwardly.

* * * * *